US012428195B2

(12) United States Patent
Enemark et al.

(10) Patent No.: US 12,428,195 B2
(45) Date of Patent: Sep. 30, 2025

(54) CLOSURE DEVICE FOR A PAPER OR PAPERBOARD-BASED PACKAGE

(71) Applicant: Elopak GmbH, Mannheim (DE)

(72) Inventors: Frode Enemark, Silkeborg (DK); Sebastian Lauhof, Gross Schwulper (DE)

(73) Assignee: Elopak GmbH, Mannheim (DE)

( * ) Notice: Subject to any disclaimer, the term of this patent is extended or adjusted under 35 U.S.C. 154(b) by 329 days.

(21) Appl. No.: 17/791,911

(22) PCT Filed: Jan. 26, 2021

(86) PCT No.: PCT/EP2021/051737
§ 371 (c)(1),
(2) Date: Jul. 11, 2022

(87) PCT Pub. No.: WO2021/151880
PCT Pub. Date: Aug. 5, 2021

(65) Prior Publication Data

US 2023/0048599 A1 Feb. 16, 2023

(30) Foreign Application Priority Data

Jan. 27, 2020 (EP) ..... 20153936

(51) Int. Cl.
*B65D 5/74* (2006.01)
*B65D 41/34* (2006.01)
*B65D 55/16* (2006.01)

(52) U.S. Cl.
CPC ..... *B65D 5/746* (2013.01); *B65D 5/747* (2013.01); *B65D 41/3447* (2013.01); *B65D 55/16* (2013.01); *B65D 2401/30* (2020.05)

(58) Field of Classification Search
CPC ..... B65D 5/746; B65D 41/3447; B65D 5/747
See application file for complete search history.

(56) References Cited

U.S. PATENT DOCUMENTS 5,141,133 A 8/1992 Ninomiya et al.
6,223,924 B1 5/2001 Ek et al.
(Continued)

FOREIGN PATENT DOCUMENTS

DE 102010028518 11/2011
DE 202019106993 5/2020
(Continued)

OTHER PUBLICATIONS

Third party observations in application 20153936.8.
(Continued)

*Primary Examiner* — Jeremy Carroll
(74) *Attorney, Agent, or Firm* — Christian D. Abel

(57) ABSTRACT

The invention relates to a closure device (1) comprising a pour spout (100) and a cap (200), the cap comprising a lid portion (300), a hinge portion (500) and a retainment portion (500), the hinge portion permanently linking the lid portion to the retainment portion and the retainment portion being permanently retained around the pour spout, the lid portion being re-sealably arranged on the pour spout allowing the closure device to be brought between an open position and a closed position. The pour spout comprises an annular longitudinal neck portion (102) extending along an axial direction (z) from a first axial (104) end to a second axial end (106) in a dispensing opening (118). The neck portion further comprises a plurality of external threads (108), occupying, in the axial direction (z) a region (109) located between a first plane ($P_1$) and a second plane ($P_2$), wherein the second plane ($P_2$) is arranged between the first plane ($P_1$) and the second axial end. The hinge portion is having a pivot axis ($A_P$) about which the lid portion is pivotally movable. The pivot axis $A_P$ is located between the first plane ($P_1$) and the second axial end (106) of the neck portion. The invention
(Continued)

also relates to an assembly comprising a paper or paperboard-based package (50) and such a closure device (1).

15 Claims, 8 Drawing Sheets

(56) References Cited

U.S. PATENT DOCUMENTS

| | | | | |
|---|---|---|---|---|
| 7,841,484 | B2 | 11/2010 | Kaneko et al. | |
| 10,676,261 | B2 | 6/2020 | Berge | |
| 2003/0071007 | A1* | 4/2003 | Ma | B29C 43/42 215/344 |
| 2008/0257849 | A1* | 10/2008 | Farrar | B65D 39/10 215/44 |
| 2009/0277859 | A1 | 11/2009 | Von Spreckelsen et al. | |
| 2012/0285921 | A1 | 11/2012 | Kwon | |
| 2012/0298666 | A1 | 11/2012 | Kwon | |
| 2013/0043260 | A1* | 2/2013 | Barron | B65D 5/748 220/694 |
| 2015/0251827 | A1* | 9/2015 | Campbell | B65D 55/16 215/258 |
| 2020/0331663 | A1* | 10/2020 | Edie | B65D 41/0471 |
| 2022/0340340 | A1* | 10/2022 | Bassi | B65D 55/16 |
| 2023/0025075 | A1 | 1/2023 | Leuenberger et al. | |
| 2023/0048599 | A1* | 2/2023 | Enemark | B65D 55/16 |
| 2023/0091799 | A1 | 3/2023 | Enemark et al. | |

FOREIGN PATENT DOCUMENTS

| | | |
|---|---|---|
| DE | 202020100758 | 5/2020 |
| EP | 1088764 | 4/2001 |
| EP | 3715274 | 9/2020 |
| EP | 3854716 | 7/2021 |
| FR | 1190251 | 10/1959 |
| JP | 2009220889 | 10/2009 |
| JP | 2011-219112 | 11/2011 |
| JP | 2019-85126 | 6/2019 |
| JP | 2019534218 | 11/2019 |
| WO | 2009001986 | 12/2008 |
| WO | 2010106327 | 9/2010 |
| WO | 2014200165 | 12/2014 |
| WO | 2019238988 | 12/2019 |
| WO | WO 2020/099200 | 5/2020 |
| WO | 2020/212430 | 10/2020 |

OTHER PUBLICATIONS

Third Party Observations to Rule 114(2)EPC in EP application 20203931.9.

EESR for EP2015393.8 submitted inter alia as a statement of relevance for any non-English references cited therein.

EESR for EP2020393.9 submitted inter alia as a statement of relevance for any non-English references cited therein.

ISR and WOISA for PCT/EP2021/051737 submitted inter alia as a statement of relevance for any non-English references cited therein.

ISR and WOISA for PCT/EP2021/051739 submitted inter alia as a statement of relevance for any non-English references cited therein.

Search report from USPTO.

Office Action from JP Patent Office of Oct. 9, 2024.

Translation of JP office action.

* cited by examiner

A

B

C

CLOSURE DEVICE FOR A PAPER OR PAPERBOARD-BASED PACKAGE

TECHNICAL FIELD

The present invention relates to a closure device comprising a pour spout and a cap having a re-sealable lid portion. In particular, the present invention relates to a hinge closure device, e.g. a closure device in which the lid portion is permanently retained to the pour spout via the hinge.

The invention also relates to an assembly comprising a package and a hinge closure device. In particular, the present invention relates to such an assembly wherein the package comprises a paper or paper-based package. A paper-based package is sometimes referred to as a "carton" and is commonly used to distribute pourable products, e.g. liquid consumable products, e.g. dairy products, such as milk, or fruit juices.

BACKGROUND OF THE INVENTION

A package or carton is typically produced from a laminate packaging material, which typically comprises a multi-ply paper or paperboard sheet on which is laminated one or a plurality of barrier layers for holding the pourable product, e.g. a liquid, and/or prevent migration of air and flavour degrading substances through the paper or paperboard sheet. A barrier layer may typically comprise a polyethylene or an aluminium layer.

Using a hinge closure device on a package prevents users from misplacing and losing the lid portion when operating the package, e.g. when pouring liquid from the package.

Within the art, different types of hinge closure devices are known.

US 2012/298,666 A1 discloses a stopper/hinge closure device for a packaging container having a long neck portion. The stopper includes bridges for checking whether a screw-coupling type stopper is opened or not and a hinge portion where an inner concave groove is formed, thereby enabling the stable connection of a stopper body/lid and a fixing ring for maintaining a set opening angle of the stopper body in case of opening, to thus prevent the stopper body from drooping and being shaken, and thereby elastically carrying out opening and closing operations.

U.S. Pat. No. 6,474,491 B1 discloses a closure device comprising a cap which includes a ring held axially on that part of the container which delimits the opening of this container, and two arms in the form of an arc of a circle, each of which is connected to the cap on the one hand, by means of a film hinge and parts that are able to fold, and to the ring on the other hand. These arms allow the cap to be tilted outwards with respect to the container so as to be released from the opening of the container, however the arms being thin and easily damaged or deformed. The complex structure of the closure device makes the manufacturing comprehensive.

An object of the invention is to provide a liquid tight closure device which is easy to open and close being less susceptible to damage and/or deformation than known closure devices.

It is further an object of the invention to provide a closure device which is simple and economical to manufacture.

It is also an object of the present invention to provide a closure device which when in an open position, does not interfere with a dispensing operation, e.g. a pouring operation.

Yet another object of the invention is to provide a closure device which is easy to use by having an improved opening and closing functionality compared to prior art.

SUMMARY OF THE INVENTION

The present invention provides a hinged closure device for a paper or paperboard-based package which is possible to rotate and flip open making it consumer friendly. A hinge is provided between a lid portion and a retainment portion to ensure that these two parts are kept together even when the cap is flipped and pivoting away from the spout. The hinged closure device may be liquid tight.

According to an example aspect the present invention provides a closure device comprising:

- a pour spout and a cap;
  - the pour spout having a longitudinal centre axis $A_L$ defining an axial direction z, a circumferential direction c and a radial direction r of the pour spout;
  - the pour spout comprising:
    - an annular longitudinal neck portion extending along the axial direction z from a first axial end to a second axial end in a dispensing opening, the neck portion further comprising a plurality of external threads, occupying, in the axial direction z a region located between a first plane $P_1$ and a second plane $P_2$, wherein the second plane $P_2$ is arranged between the first plane $P_1$ and the second axial end; and
    - an annular flange portion for attaching the closure device to the package, the annular flange portion extending in the radial direction r outwardly from the second axial end of the neck portion;
  - the cap comprising:
    - a lid portion comprising an annular longitudinal skirt having at least one internal thread configured to releasably interact with said external threads;
    - a retainment portion being rotatably retained around said neck portion; and
    - a hinge portion permanently connecting the lid portion to the retainment portion, the hinge portion having a pivot axis $A_P$ about which the lid portion is pivotally movable.

The lid portion is operable between a first position in which the lid portion sealingly covers said dispensing opening, a second position in which the lid portion non-sealingly covers the dispensing opening and a third position in which the lid portion is located at least partly at a side of the dispensing opening.

Further, the pivot axis $A_P$ of the hinge portion is located between the first plane $P_1$ and the second axial end of the neck portion.

In another example aspect, the pivot axis $A_P$ of the hinge portion may be located level with the second plane $P_2$ or between the first and second planes $P_1$, $P_2$.

In yet another example aspect, the pivot axis $A_P$ of the hinge portion may be located between the second plane $P_2$ and the second axial end.

In a further example aspect, the pivot axis $A_P$ of the hinge portion may be located proximate or level with the second plane $P_2$.

When the lid portion is arranged in the first closed position the cap has a longitudinal centre axis corresponding to the longitudinal centre axis $A_L$ of the pour spout. The cap has, in this position, an axial extent comprising the annular longitudinal skirt and the retainment portion extending between the first and second axial end of the pour spout.

The hinge portion may be arranged in a so-called raised position such that an axial extent of the retainment portion arranged below the hinge portion may be from 100% to 200% longer than the axial extent of the retainment portion positioned opposite the hinge portion in the circumferential direction, preferably from 100% to 150% longer. Further, the retainment portion may be dome shaped below the hinge portion.

Such raised hinge portion allows for easier opening and closing of the lid portion in that the lid portion easier arranges around the pour spout when being operated by a consumer. If the hinge portion is not raised the pour spout may serve as an obstacle hindering the lid portion to be arranged around the pour spout when operating the lid portion from the third to the second position.

The annular longitudinal neck portion may define a through-going dispensing channel. The first end of the neck portion may define an inlet opening of the dispensing channel and the second end of the neck portion may define an outlet opening of the dispensing channel forming said dispensing opening, allowing content to be dispensed through the closure device during a dispensing operation.

The inlet opening may define an inlet opening plane of the neck portion and the outlet opening may define an outlet opening plane of the neck portion. Said pivot axis $A_P$ may be located between the first plane $P_1$ and the outlet opening plane.

The pivot axis $A_P$ may be orthogonal to the longitudinal axis $A_L$.

The pivot axis $A_P$ may be arranged in a third plane $P_P$ and the third plane $P_P$ may be parallel with the first plane $P_1$ and/or the second plane $P_2$ and/or the outlet plane and/or the inlet plane of the pour spout.

The third plane $P_P$ may be the same during all three positions of the lid portion, i.e. the first position in which the lid portion sealingly covers said dispensing opening of the pour spout, the second position in which the lid portion non-sealingly covers the dispensing opening and the third position in which the lid portion is located at least partly at a side of the dispensing opening. In other words, the pivot axis $A_P$ may be located in the same plane when in the first, second and third positions.

When the lid portion is arranged in the first position sealingly/liquid tight covering the opening of the pour spout, the internal thread(s) is interacting with the external threads such that the lid portion can only be moved to the second position by rotating the cap in a first direction about the longitudinal centre axis $A_L$, e.g. counter-clockwise. In the second position the internal thread(s) is not interacting with the external threads, hence, once the lid portion has reached the second position, the lid portion can be flipped around the pivot axis $A_P$ of the hinge portion to the third position. In a preferred embodiment the lid portion is flipped at least 80° from the second position to the third position about the pivot axis $A_P$.

When the lid portion is arranged in the third/open position it may be flipped back to the second position about the pivot axis $A_P$ and thereafter rotated in a second direction about the longitudinal centre axis $A_L$ opposite said first direction, e.g. clockwise, until it is in the first/closed position.

The external threads are running helically along the outer surface of the pour spout. Further the external threads may be discretely and evenly distributed within the region located between the first plane $P_1$ and the second plane $P_2$. The pour spout may comprise from 4 to 10 external threads, preferably from 5 to 8 external threads or more preferably 6 external threads.

The external threads may have a circumferential extent about or around an outer surface of the pour spout where the circumferential extent of each external thread may be any one of: within the range of 50° to 140°; within the range of 70° to 120°; within the range of 80° to 100°; and 90°.

In the circumferential direction of the pour spout, neighbouring external threads may partially overlap.

The external and internal threads may be helically arranged. The helix angle of the internal and external threads may be any one of: within the range of 5.0° to 10.0°; within the range of 6.0° to 9.0°; within the range of 7.0° to 8.0°; and 7.5°.

The at least one internal thread may have a circumferential extent about or around an inner surface of the annular longitudinal skirt of the lid portion, where the circumferential extent of the at least one internal thread may be any one of: within the range of 20° to 100°; within the range of 30° to ° 90; within the range of 60° to 80°; and 70°. The at least one internal thread may advantageously have a shorter circumferential extent than the external threads.

Said at least one internal thread may comprise an internal thread having a tangential centre point located at a circumferential distance from a tangential centre point of the hinge portion being any one of: within the range of 160° to 200°; within the range of 170° to 190°; within the range of 175° to 185°; and 180°.

Said at least one internal thread may alternatively or in addition comprise an internal thread having a tangential centre point located at a circumferential distance from the tangential centre point of the hinge portion being any one of: within the range of 60° to 120°; within the range of 70° to 110°; within the range of 80° to 100°; and 90°.

Said at least one internal thread may alternatively or in addition comprise an internal thread having a tangential centre point located at a circumferential distance from the tangential centre point of the hinge portion being any one of: within the range of 240° to 300°; within the range of 250° to 290°; within the range of 260° to 280°; and 270°.

The annular skirt may comprise exactly one internal thread. Further, the hinge portion may be arranged at the periphery of the annular longitudinal skirt of the lid portion. The hinge portion may have a tangential centre point $C_H$ arranged at a circumferential distance of about 180° from a tangential centre point the internal thread.

Alternatively, the annular skirt may comprise exactly two internal threads; i.e. a first internal thread and a second internal thread. The first internal thread may have a tangential centre point $C_F$ located at a circumferential distance from a tangential centre point $C_S$ of the second internal thread. The circumferential distance may be any one of; within the range of 150° to 185°; within the range of 170° to 180°; within the range of 175° to 180°; and 180°.

Further, the hinge portion may have a tangential centre point $C_H$ arranged at a circumferential distance from the tangential centre point $C_F$ of the first internal thread. The circumferential distance may be any one of: within the range of 60° to 85°; within the range of 65° to 80°; and 70°.

In another alternative, the annular skirt may comprise exactly three internal threads; i.e. a first, second and third internal thread. The first internal thread may have a tangential centre point $C_F$ located at a circumferential distance from a tangential centre point $C_S$ of the second internal thread. The circumferential distance may be any one of; within the range of 150° to 185°; within the range of 160° to 180°; within the range of 170° to 180°; and 175°.

The hinge portion may have a tangential centre point $C_H$ arranged at a circumferential distance from the tangential centre point $C_F$ of the first internal thread. The circumferential distance may be any one of: within the range of 60° to 110°; within the range of 70° to 90°; and 85°. The tangential centre $C_T$ point of the third thread may be arranged opposite the tangential centre point $C_H$ of the hinge portion, or from 170 to 180° from the tangential centre point $C_H$ of the hinge portion.

Further, the first and second internal threads may have equal circumferential extents being larger than the circumferential extent of the third internal thread. For example, the circumferential extent of the first and second internal threads may be within the range of 40° to 80° whilst the circumferential extent of the third internal thread is within the range of 10° to 45° preferably being less than the circumferential extent of the first and second threads.

The third thread may serve to add additional tightening force to the closure device when moving the lid portion from second to the first position. Further, the third thread may serve to enhance the guiding of the lid portion on to the pour spout during closing of the closure device compared to the embodiment comprising two internal threads.

The hinge portion may have a butterfly configuration comprising a pair of spaced trapezoidal ends spaced by a centre portion. The centre portion may have any shape such as e.g. a rectangular structure or a dumbbell structure.

The hinge portion may define a position of equilibrium of the lid portion located between said second position and said third position, wherein the hinge portion, when the lid portion is located between the second position and the position of equilibrium, may be configured to bias the lid portion to rotate towards the second position, and wherein the hinge portion, when the lid portion is located between the position of equilibrium and the third position, may be configured to bias the lid portion to rotate towards the third position. Consequently, depending on the position of the lid portion, the hinge portion may be configured to bias the lid portion to rotate either towards the second position or towards the third position, thus ensuring that the lid portion does not become stationary or fixed between the second and third positions.

The pour spout may comprise an annular sealing tongue arranged at the second axial end. The sealing tongue may extend towards the longitudinal centre axis $A_L$ of the pour spout in the radial direction r.

The sealing tongue may be oblique in the direction towards the first axial end of the pour spout.

The lid portion of the cap may comprise an annular longitudinal bore seal having a common centre axis, Ac, with the annular longitudinal skirt; the bore seal and the skirt both extending in a same longitudinal direction and being arranged such that the second axial end of the pour spout is arranged between the skirt and the bore seal when the lid portion is in the first position. In other words, the bore seal and the skirt define between themselves an annular space configured to receive the second axial end of the pour spout when the lid portion is in the first/closed position. The longitudinal direction of the annular longitudinal skirt is parallel to the axial direction z of the pour spout when the lid portion is in the first/closed position.

The radial extent of the sealing tongue of pour spout may be less than or equal the radial distance between inner surface of the annular longitudinal skirt and the bore seal of the lid portion.

The bore seal may have a gradually increasing longitudinal extent from a first point of the bore seal being proximate the hinge portion towards a second point of the bore seal being distal the hinge portion. The bore seal contributes to guide and align the lid portion onto the pour spout when bringing the lid portion from the open/third position to the second position.

The first point of the bore seal which is proximate the hinge portion may have a longitudinal extent extending between the second axial end of the pour spout and the third plane $P_P$ of the pivot axis $A_P$ of the hinge portion when the lid portion is in the first position.

The radial extent of the sealing tongue of the pour spout may be less than or equal the radial distance between inner surface of the annular longitudinal skirt and the bore seal of the lid portion providing a leak tight closure device.

The closure device may further comprise a separation line/rupturable section extending circumferentially around the cap between a first endpoint and a second end point defining between them the hinge potion. The separation line may be configured to separate the lid portion from the retainment portion when the lid portion is brought from the first position to the second position.

The pour spout may further comprise an annular, radially extending lip configured to deny the retainment portion axial movement along the pour spout towards the dispensing opening of the pour spout. The separation line, when the closure device is in the closed position, may advantageously be arranged at an axial distance from the dispensing opening that is larger than the axial distance between the lip and the dispensing opening.

The internal thread(s) may be arranged such that at least a bulk portion of the internal thread(s) is arranged closer to the end-wall of the lid portion than to the separation line when the lid portion is arranged in the first closed position.

The lid portion and the retainment portion are both rotationally arranged about the pour spout making it is possible to close/flip back and close the lid portion of the closure device from all positions around the pour spout. Hence a consumer may freely move the lid portion about the pour spout for enhancing the pouring therefrom during use.

According to another example aspect the present invention provides an assembly comprising a paper or paperboard-based package and a closure device as disclosed above.

The disclosed embodiments of the closure device may be configured to be used in a liquid packaging carton or package comprising a multi-ply paper or paperboard sheet on which may be laminated one or a plurality of barrier layers for holding liquid and/or prevent migration of air and flavour degrading substances through the paperboard. Such liquid packaging containers are commonly used for distributing dairy products, e.g. milk, or juices. Typically, closure devices for such applications are made from polyethylene and it is preferable that the disclosed closure device of the invention is made from this material.

Above-discussed preferred and/or optional features of each aspect may be used, alone or in appropriate combination, in the other aspects of the invention.

BRIEF DESCRIPTION OF THE DRAWINGS

Following drawings are appended to facilitate the understanding of the invention.

In the drawings, like reference numerals have been used to indicate like parts, elements or features unless otherwise explicitly stated or implicitly understood from the context.

DETAILED DESCRIPTION OF THE INVENTION

In the following, embodiments of the invention will be described in more detail with reference to the drawings. However, it is specifically intended that the invention is not limited to the embodiments and illustrations contained herein but includes modified forms of the embodiments including portions of the embodiments and combinations of elements of different embodiments as come within the scope of the following claims.

It is appreciated that certain features of the invention, which, for clarity, have been described above in the context of separate embodiments, may also be provided in combination in a single embodiment. Conversely, various features of the invention, which, for brevity, have been described in the context of a single embodiment, may also be provided separately or in any suitable sub-combination. In particular, it will be appreciated that features described in relation to one particular embodiment may be interchangeable with features described in relation to other embodiments.

In the following an embodiment of a closure device 1 according to the invention will be discussed in more detail with reference to FIGS. 1 to 7.

Figure 1:
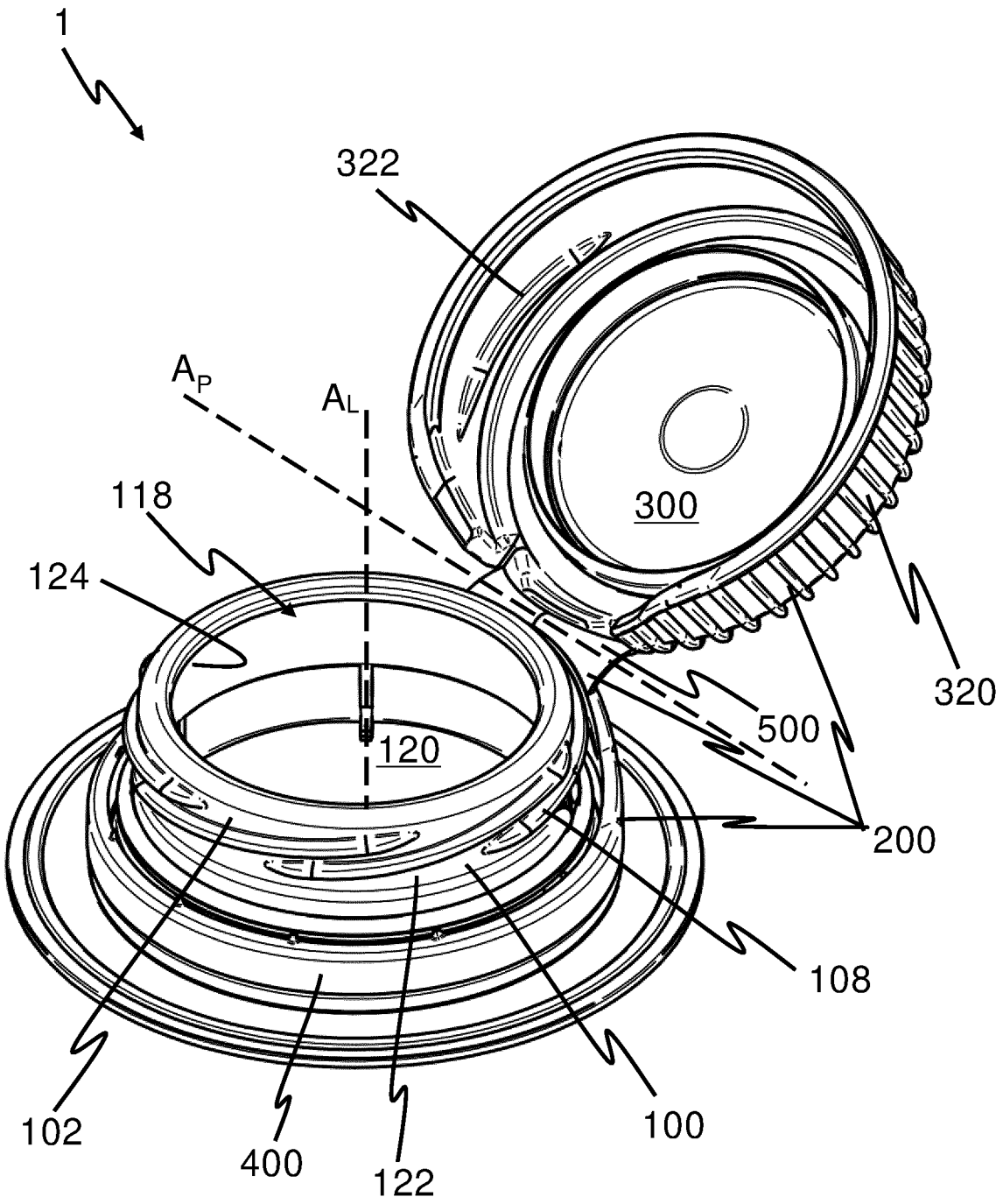
FIG. 1 is a perspective view of a closure device according to the invention with the lid portion arranged in the third position.
Figure 2:
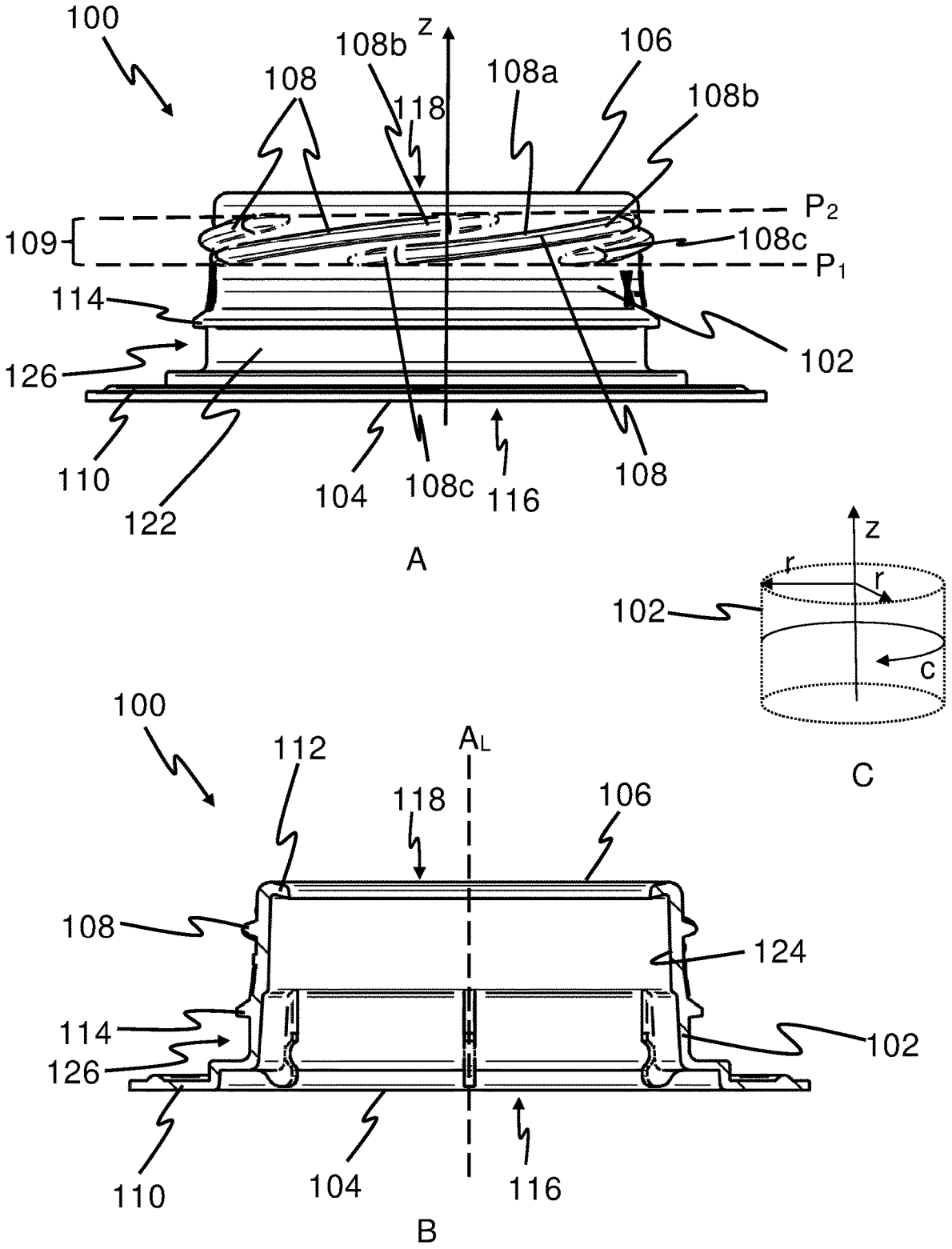
FIG. 2A is a side view of the pour spout of the closure device shown in FIG. 1.
FIG. 2B is a is a cross-sectional side-view of the pour spout shown in FIG. 2A.
FIG. 2C is a geometric illustration of the annular longitudinal neck portion of the pour spout of FIGS. 2A and 2B indicating the directions thereof.
Figure 3:
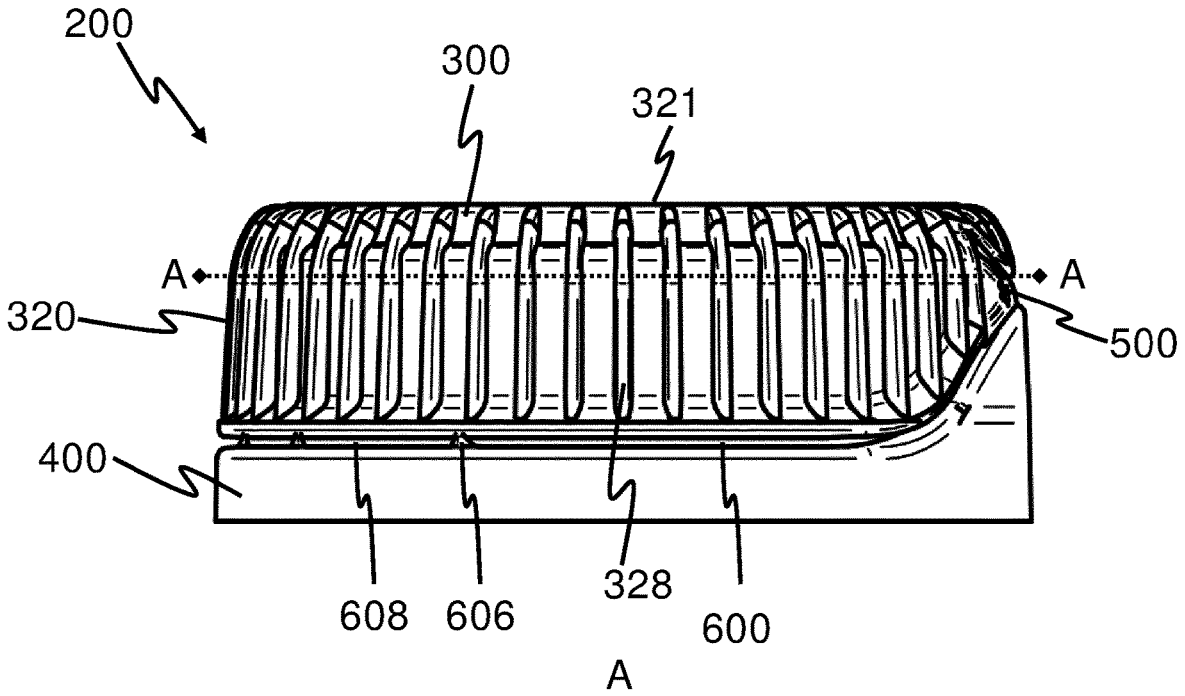
FIG. 3A is a side-view of the cap of the closure device in FIG. 1.
FIG. 3B is a cross-sectional side-view of the cap in FIG. 3A.
Figure 3:
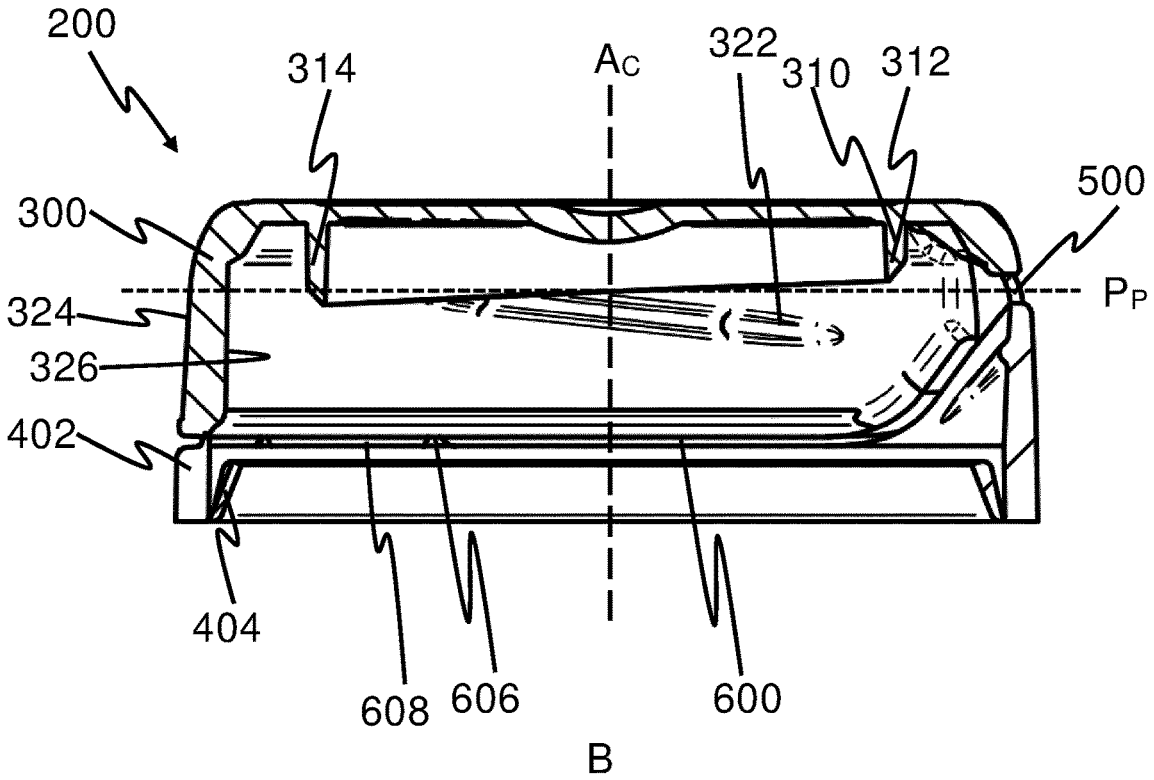

FIG. 1 shows an example embodiment of the closure device 1 of the invention. The closure device 1 generally comprises a pour spout 100 and a cap 200. The cap 200 comprises a retainment portion 400 circumferentially arranged around the pour spout 100, a lid portion 300 and a hinge portion 500 permanently connecting the lid portion 300 to the retainment portion 400.

The illustrated closure device 1 of FIG. 1 is in an open position such that the content within a package (not shown), which the closure device 1 is attached to, can be poured out through a dispensing opening 118 of the closure device 1.

The pour spout 100 is having an annular longitudinal neck portion 102 comprising an inner surface 124 forming a dispensing channel 120 having a central axis $A_L$. The annular longitudinal neck portion 102 is having the shape of a tubular cylinder. A plurality of external threads 108 are arranged on the outer surface 122 of the pour The lid portion comprises an annular longitudinal skirt 320 having two internal threads 322.

The retainment portion 400 of the cap 200 is circumferentially arranged around the neck portion 102 in a position not overlapping with the external threads 108.

The hinge portion 500 is permanently connecting the lid portion 300 to the retainment portion 400 and allowing the lid portion 300 pivoting around pivot axis $A_P$ of the hinge portion 500.

In the shown embodiment the lid portion 300 is pivoting away from the dispensing opening 118 of the closure device 1 such that the cap 200 is located at the side of the dispensing opening 118 of the pour spout 100. Hence, the lid portion 300, in this open position of the closure device 1, is moved away from the central axis $A_L$ of the pour spout 100 around the pivot axis $A_P$ sufficiently far to allow nearly unrestricted disposal of content through the dispensing opening 118 of the pour spout 100.

FIG. 2A shows a side-view of the pour spout 100 of FIG. 1, while FIG. 2B shows a cross-sectional side-view of the same pour spout 100.

With reference to FIGS. 2A and 2B, the pour spout 100 comprises a neck portion 102 defining an axial, throughgoing channel 120 (see FIG. 1) and comprises a first, bottom axial end 104, where the neck portion 102 displays a first bottom, inlet opening 116 of the channel and a second, top axial end 106, where the neck portion 102 displays a second top, outlet opening 118 of the channel, which second opening 118 is defined by a sealing tongue 112 and forms said dispensing opening 118 of the pour spout 100.

Figure 8:
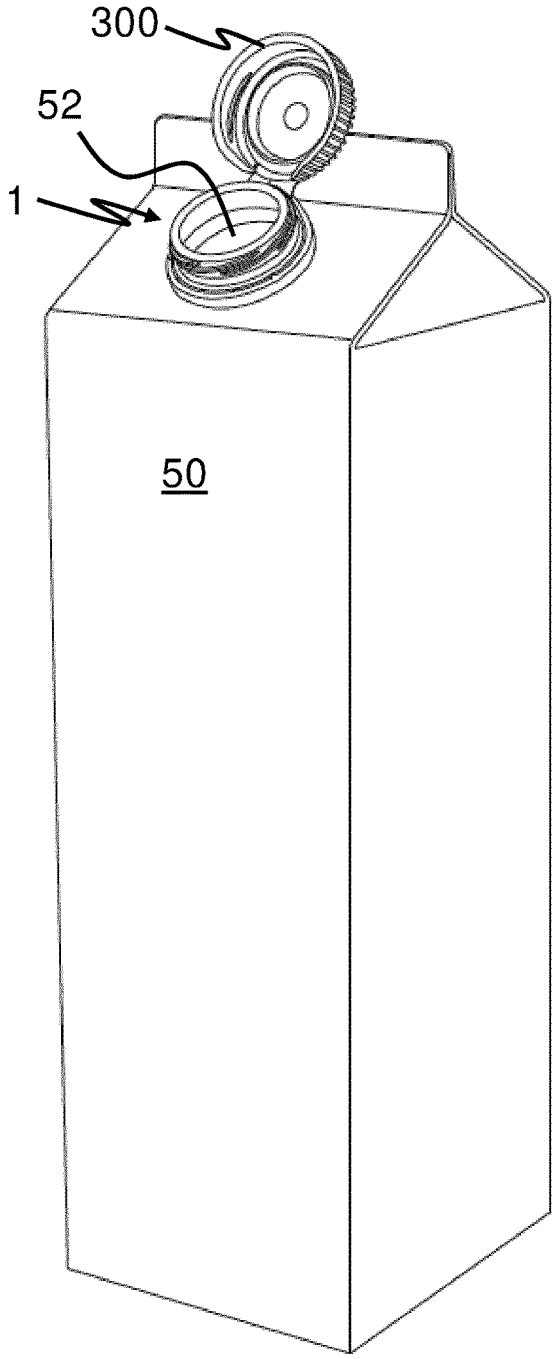
FIG. 8 is a perspective view of a paperboard-based package comprising the closure device.

The pour spout 100 further comprises an annular, radially and outwardly extending flange portion 110 configured to be attached to a container in the form of a paper or paperboard-based package/carton (see FIG. 8). The flange portion 110 extends from the bottom end 104 of the neck portion 102.

For reasons of convenience, the description below considers that the term "upwards" corresponds to an axial longitudinal direction (z) that is generally parallel to the central axis $A_L$ of the pour spout 100 and that goes from the first opening 116 towards the second opening 118, whereas the term "downwards" corresponds to the opposite direction. The terms "top"-"bottom" and "upper"-"lower", correspond to relative positions with reference to this direction and the terms "inner"-"outer" correspond to relative positions with reference to a direction which is perpendicular to this direction.

The neck portion 102 displays an inner surface 124 (see FIG. 1) and an outer surface 122. The inner surface 124 (see FIG. 1) is generally rotational-symmetric about the longitudinal central axis $A_L$ of the pour spout 100 and defines an inner side wall of the channel 120. At the lower part of the neck portion 102, the outer surface 122 is provided with an annular, radially extending blocking tongue/ridge 114, sometimes referred to as a "bead ring". The blocking tongue 114 displays an annular, downwardly facing surface which is generally planar and perpendicular to the longitudinal central axis $A_L$ of the pour spout 100. Together with the flange portion 110, this surface defines an annular recess 126 configured for receiving and rotationally retaining the retainment portion of the cap which will be discussed in more detail below in relation to FIG. 6.

The outer surface 122 is also provided with external threads 108 starting adjacent and below the sealing tongue 112 at a second plane $P_2$ and running helically along the outer surface 122 towards the blocking tongue 114 until a first plane $P_1$. Consequently, in the longitudinal direction of the pour spout, the external threads 108 occupy a region 109 between the first and second planes, $P_1$ and $P_2$. The first and second planes, $P_1$ and $P_2$, are orthogonal to the longitudinal central axis $A_L$.

In this shown embodiment, the neck portion 102 of the pour spout 100 comprises a total of six identical external threads 108 discretely and evenly distributed in the circumferential direction c of region 109. Each external thread 108 comprises a centre portion 108*a* and a first and second end portion 108*b*,108*c*. The first end portion 108*a* is arranged in proximity with the second plane $P_2$, while the second end portion 108*c* is arranged in proximity with first plane $P_1$. The first end portion 108*b* of an external thread 108 is overlappingly arranged in the circumferential direction c with the second end portion 108*c* of the adjacent external thread 108, while not overlappingly arranged in the axial direction z. The centre portion 108*a* of each thread 108 is arranged in a non-overlapping arrangement with another external thread 108 in both the circumferential direction c and the axial direction z.

Consequently, in regions where neighbouring threads 108 overlap, a cross-sectional side-view of the side wall of the neck portion 102 will reveal two threads—one positioned above the other, whereas in regions between overlapping threads, a cross-sectional side-view of the side wall will reveal only one thread 108, as is shown in FIG. 2B.

The centre portion 108*a* of the external thread 108 may have a circumferential extent of about 25% to 35% or 27% to 33% or 30% of the total length of the external thread 108. The first end portion 108*b* may have the same circumferential extent as the second end portion 108*c*.

FIG. 2C is a geometric illustration of the annular longitudinal neck portion 102 of the pour spout 100 of FIGS. 2A and 2B indicating the circumferential direction c, the radial direction r and the axial direction z of the neck portion 102.

FIG. 3A shows a side-view of the cap 200 of FIG. 1, while FIG. 3B shows a cross-sectional side-view of the same cap 200.

The cap 200 comprises a lid portion 300, a hinge portion 500 and a retainment portion 400 (see also FIGS. 1). The hinge portion 500 is configured to permanently hinge the lid portion 300 to the retainment portion 400. The retainment portion 400 is rotationally retained around the pour spout 100 as shown in FIG. 1.

The lid portion 300 is open at its bottom end and closed at its top end by an end-wall 321, at the outer periphery of which an annular longitudinal/tubular skirt 320 extends axially downwards, which annular longitudinal skirt 320 is centred on a central axis Ac and has a circular base.

In the disclosed embodiment, the lid portion 300 is provided with an annular longitudinal bore seal 310 that extends axially downwards from the end-wall 321 in such a manner as to be centred on the central axis Ac inside the longitudinal skirt 320. Hence, the annular longitudinal bore seal 310 shares a common centre axis with the annular longitudinal skirt 320.

As shown in FIG. 3B the bore seal 310 has a gradually increasing longitudinal extent from a first position 312 being proximate the hinge portion 500 towards a second position 314 being distal the hinge portion 500. The longitudinal extent of the bore seal is adapted to avoid any collision between the bore seal 310 and the sealing tongue of the pour spout when operating the lid portion 300 from the third/open position towards the second position as further described below with reference to FIGS. 6A to 6C.

As shown in FIG. 1 the hinge portion 500 of the cap 200 is permanently connecting the lid portion 300 to the retainment portion 400 and allowing the lid portion 300 pivoting around pivot axis $A_P$ of the hinge portion 500. As can be seen from FIG. 3B the pivot axis $A_P$ is arranged at a third plane $P_P$ which can be level with or between the first and second planes $P_1$, $P_2$ shown in FIG. 2A. In FIG. 6B it is shown that the third plane $P_P$ is arranged between the first and second planes $P_1$, $P_2$.

The annular skirt potion 320 has an outer surface 324 which comprises a plurality of parallel spines 328 and an inner surface 326 comprising a plurality of internal threads 322. The spines 328 are arranged for improving the grip of a user making it easier to rotate the lid portion 300. The internal threads 322 are running helically along the inside wall 314 in a manner which allows the internal threads 322 to interact with the external threads 108 of the pour spout 100 (see FIG. 6A).

In FIGS. 3A and 3B the lid portion 300 of the cap 200 is arranged in the third/closed position. A separation line 600 extends circumferentially between the annular longitudinal skirt portion 320 of the lid portion 300 and the retainment portion 400.

The retainment portion 400 comprises a first, outer section 402 and a second, inner section/lip 404 which is connected to the outer section 402 at a lower end thereof. The configuration is further discussed with regard to FIG. 6A.

A plurality of bridge portions 606 are arranged circumferentially along the separation line 600 connecting the retainment portion 400 to the lid portion 300 before the closure device is opened for the very first time. Each of the bridge portions 606 may typically have a width that is within the range of 0.2 to 0.5 mm. Between two bridge portions 606 the cap 200 may typically display through-going slits 608, thus allowing the first opening to be effectuated by a user unscrewing the cap 200 until the bridge portions 606 are deformed beyond the point of breakage.

Hence, the separation line 600 provides, during the first opening, a clean break between the retainment portion 400 and the lid portion 300. Once broken, the separation line 600 provides evidence that the closure device 1 has been opened, thus providing so called "tamper evidence".

Figure 4:
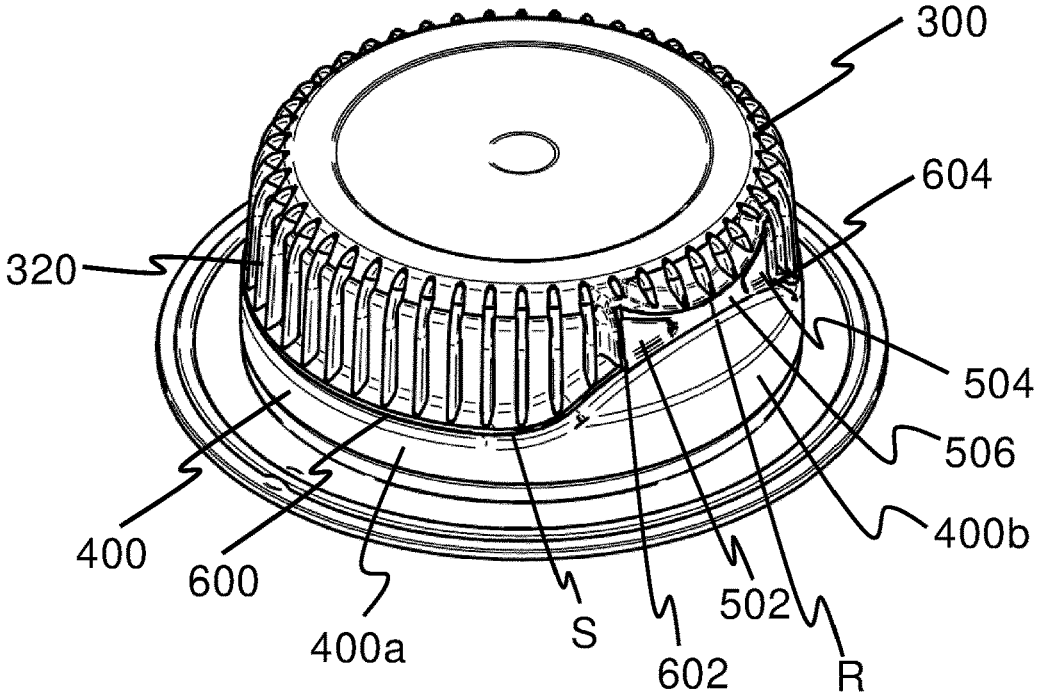
FIG. 4 is a perspective view of the closure device FIG. 1 with the lid portion arranged in the first position.

FIG. 4 shows the hinge portion 500 having a butterfly hinge system comprising a pair of spaced trapezoidal ends 502, 504 spaced by a centre portion 506, the centre portion 506 having a dumbbell shape. The hinge portion 500 is configured to define a position of equilibrium of the lid portion 300 located between said second position and said third position, wherein the hinge portion 500, when the lid portion 300 is located between the second position and the position of equilibrium, is configured to bias the lid portion 300 to rotate about the pivot axis $A_P$ towards the second position, and wherein the hinge portion 500, when the lid portion 300 is located between the position of equilibrium and the third position, is configured to bias the lid portion 300 to rotate about the pivot axis $A_P$ towards the third position. Consequently, depending on the position of the lid portion 300, the hinge portion 500 is configured to bias the lid portion 300 to rotate either towards the second position or towards the third position, thus ensuring that the lid portion 300 does not become stationary or fixed in a position between the second and third positions.

FIG. 4 further illustrates end points 602,604 of the separation line 600 which are separated by the hinge portion 500. The separation line 600 comprises a section tracing a circle and extending clockwise from a position indicated as S in FIG. 4 to a corresponding position—not visible in FIG. 4—on the other side of the hinge portion 500. The separation line 600 further comprises sections running from end points 602 and 604, respectively, to the hinge portion 500.

The hinge portion 500 is connected to the lid portion 300 at the periphery of the annular longitudinal skirt portion 320 and may have a circumferential extent within the range of 70° to 110°, thus implying that the circumferential extent of the separation line 600 may be within the range of 290° to 250°.

The retainment portion 400 comprises a first section 400*a* extending clockwise from the position indicated as S in FIG. 4 to a corresponding position—not visible in FIG. 4—on the other side of the hinge portion 500. The retainment portion 400 further comprises a second section 400*b* extending counter-clockwise from the position indicated as S in FIG. 4 to the corresponding, non-visible position on the other side of the hinge portion 500. The first section 400*a* of the retainment portion 400 has a height, i.e. an extent in the direction of the longitudinal central axis $A_L$ (e.g. see FIG. 6B), that is constant. However, in the second section 400*b* the height of the retainment portion 400 increases and at its highest region R where the retainment portion 400 connects to the hinge portion 500. The retainment portion 400 may however have other shapes enabling the pivot axis $A_P$ to be positioned above the first plane $P_1$ or between the first and second planes $P_1$,$P_2$ as shown in e.g. FIG. 6B.

Figure 5:
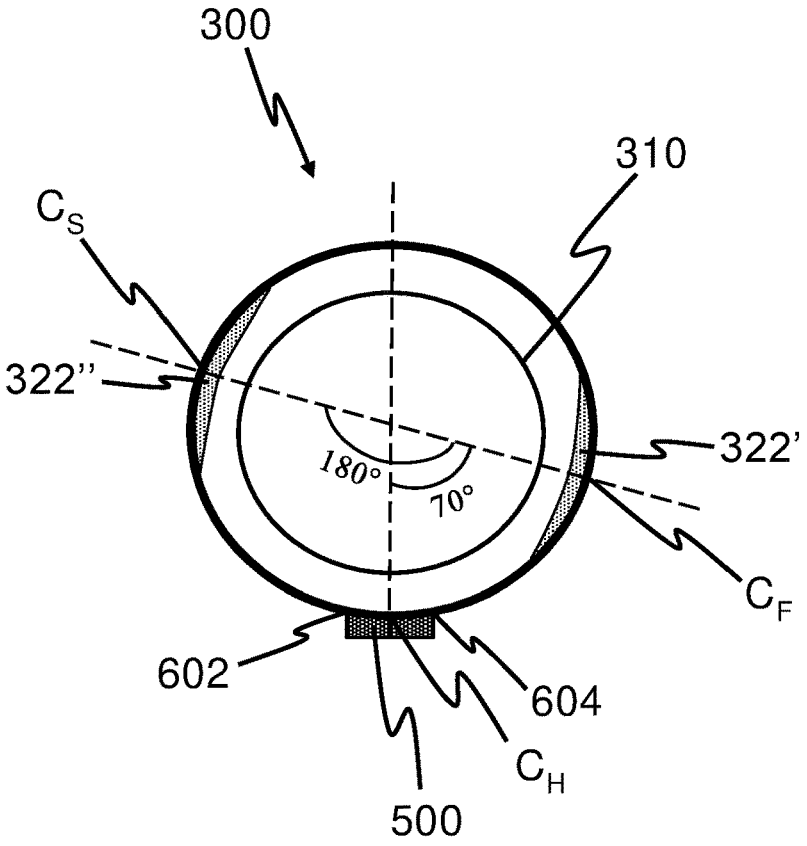
FIG. 5 is a cross-sectional top-view of the annular longitudinal skirt of the lid portion with the hinge portion according to a first example embodiment of the invention.
Figure 6:
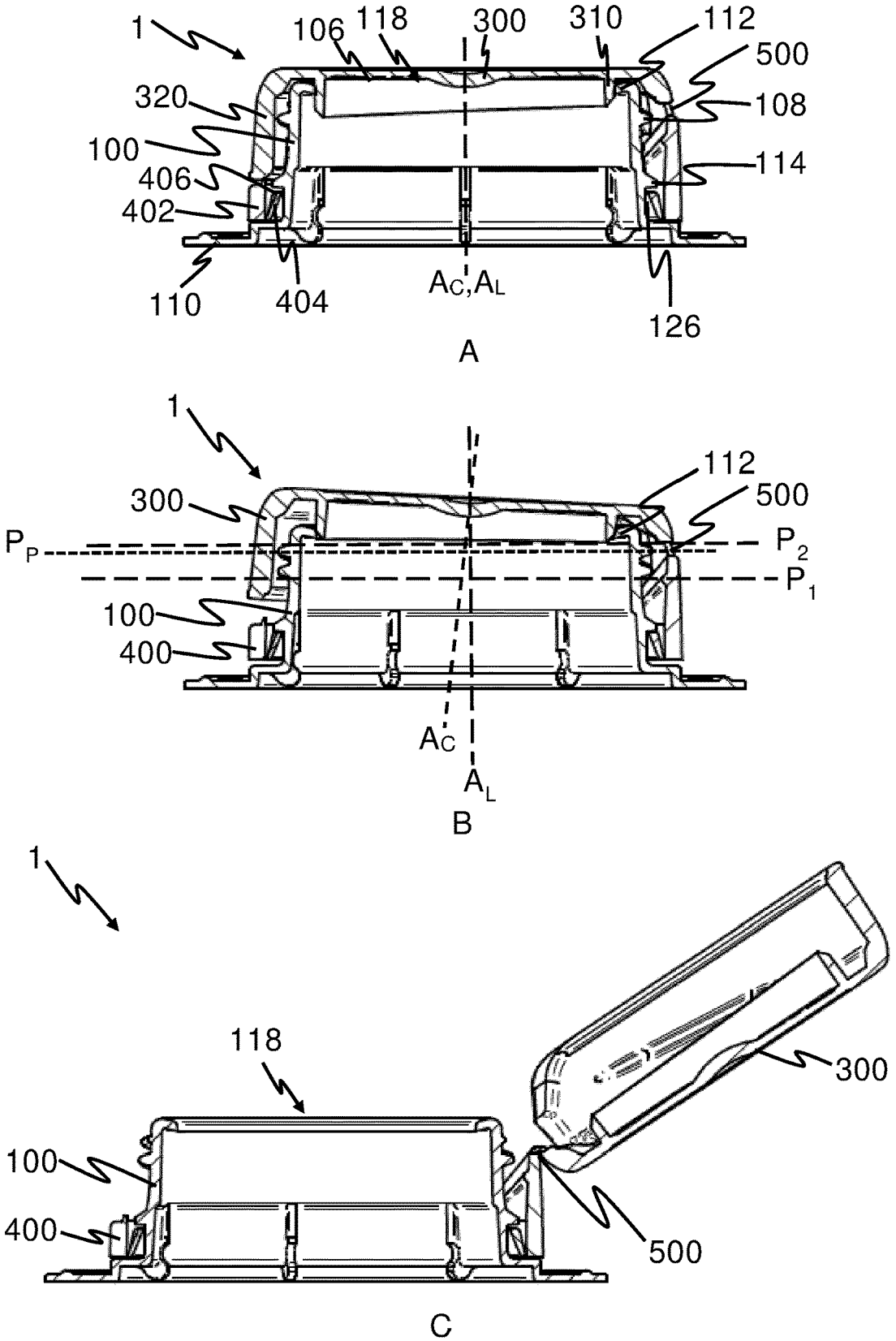
FIG. 6A is a cross-sectional view of the closure device in FIG. 1 with the lid portion arranged in the first position.
FIG. 6B is a cross-sectional view of the closure device in FIG. 1 with the lid portion arranged in the second position.
FIG. 6C is cross-sectional view of the closure device in FIG. 1 with the lid portion arranged in the third position.
Figure 7:
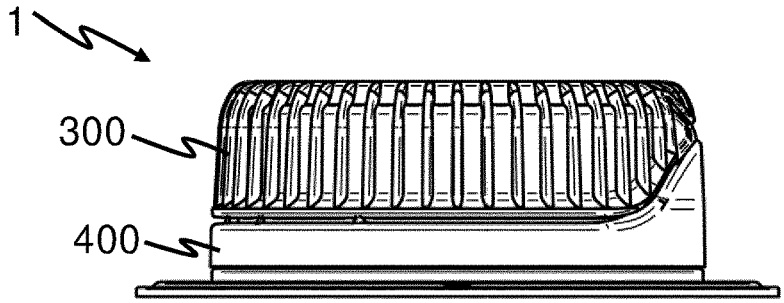
FIG. 7A is a perspective view of the closure device in FIG. 1 with the lid portion arranged in the first position.
FIG. 7B is a perspective view of the closure device FIG. 1 with the lid portion arranged in the second position.
FIG. 7C is a perspective view of the closure device FIG. 1 with the lid portion arranged in the third position.
Figure 7:
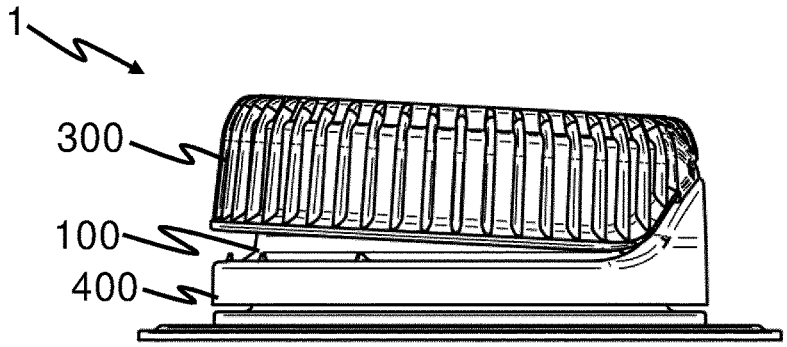
Figure 7:
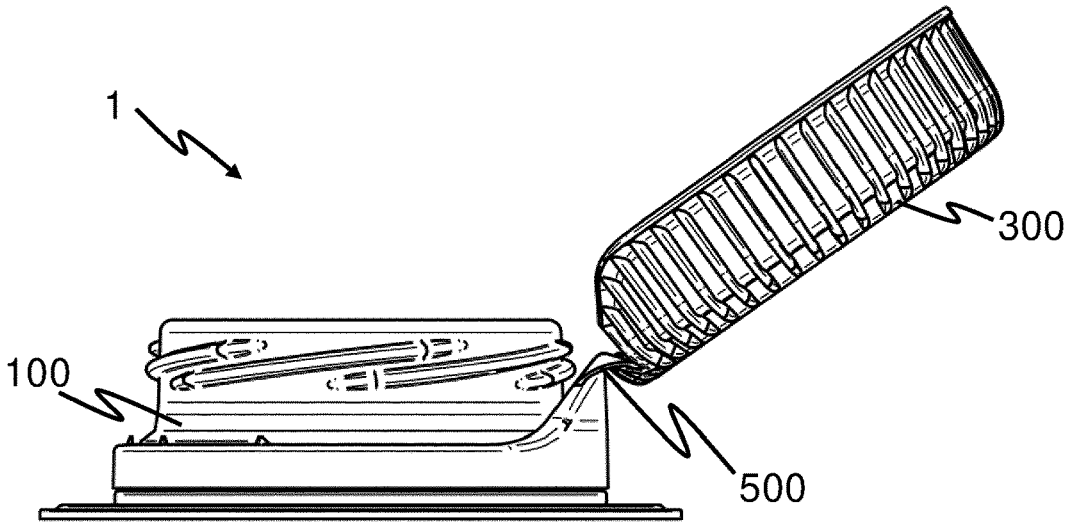
Figure 9:
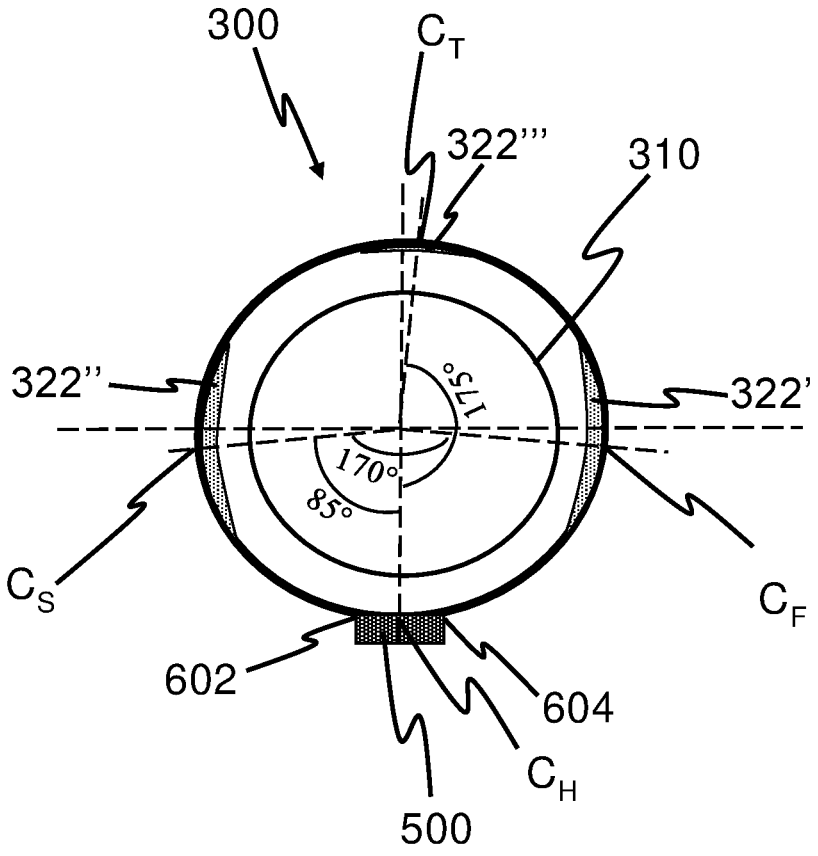
FIG. 9 is a cross-sectional top-view of the annular longitudinal skirt of the lid portion with the hinge portion according to a second example embodiment of the invention.

The embodiment of the closure shown in FIGS. 1-7 has two internal threads being according to a first embodiment shown in FIG. 5. However, the closure shown in FIGS. 1-7 may according to another second example embodiment have three internal threads as shown in FIG. 9. FIGS. 5 and 9 are both cross-sectional top-views along line A-A of FIG. 3A showing the lid portion comprising the internal threads. In FIG. 5 the lid portion 300 has two internal threads, i.e. a first and second internal thread 322', 322". The first internal thread 322' has a first tangential centre point $C_F$ and the second internal thread 322" has a second tangential centre point $C_F$ and the circumferential distance between the first and second tangential centre points $C_F$,$C_S$ is substantially 180°. Further, it is shown that the hinge portion 500 comprises a tangential centre point $C_H$ arranged substantially 70° from the first tangential centre point $C_F$ of the first internal thread 322'.

Each of the internal threads 322' and 322" may have a circumferential extent that is less than the circumferential extent of each of the external threads 108. The circumferential extent of each of the internal threads 322' and 322" may be any one of: within the range of 20°-100°; within the range of 30°-° 90; and within the range of 60°-80°.

FIG. 5 also shows the end positions 602,604 of the separation line 600 which are separated by the hinge portion 500 as shown in FIG. 4. Further, the bore seal 310 as shown in FIG. 3B is also disclosed in FIG. 5.

In FIG. 9 the lid portion 300 has three internal threads, i.e. a first, second and a third internal thread 322',322",322'". The first internal thread 322' has a first tangential centre point $C_F$, the second internal thread 322" has a second tangential centre point $C_S$ and the third internal thread 322'" has a third tangential centre point $C_T$. The circumferential distance between the first and second tangential centre points $C_F$,$C_S$ is about 170°. Further, it is shown that the hinge portion 500 comprises a tangential centre point $C_H$ arranged about 85° from the first tangential centre point $C_F$ of the first internal thread 322'. The tangential centre point $C_H$ of the hinge portion 500 is about 175° from the tangential centre point $C_T$ of the third internal thread 322'".

Each of the internal threads 322', 322",322'" show a circumferential extent that is less than the circumferential extent of each of the external threads 108 shown in FIG. 1. The circumferential extent of the first and second internal threads 322',322" are shown as equal and being about 70°.

The circumferential extent of the third internal thread 322'" is smaller than the circumferential extent of both the first and second internal thread 322',322" being about 40°.

FIG. 9 also shows the end positions 602,604 of the separation line 600 which are separated by the hinge portion 500 as shown in FIG. 4. Further, the bore seal 310 as shown in FIG. 3B is also disclosed in FIG. 9.

FIGS. 6A, 6B and 6C are cross-sectional side-views of the closure device 1 and FIGS. 7A, 7B and 7C are perspective views of the closure device 1.

FIGS. 6A and 7A shows the closure device in its first position where the lid portion 300 sealingly covers the dispersing opening 118 of the pour spout 100.

FIGS. 6B and 7B shows the closure device in its second position where the lid portion 300 non-sealingly covers the dispersing opening 118 of the pour spout 100.

FIGS. 6C and 7C shows the closure device in its first position as also shown in FIG. 1 where the lid portion 300 is arranged at the side of the dispersing opening 118 of the pour spout.

When the lid portion 300 is arranged in the first/closed position, the longitudinal central axis $A_L$ of the pour spout is equal the central axis Ac of the annular longitudinal skirt 320. In this position the end-wall 321 of the lid portion 300 (see FIG. 3A) extends above and across the dispensing opening 118 of the pour spout 100 while the longitudinal annular skirt 320 surrounds the neck portion 102 externally and the sealing tongue 112 of the pour spout 100 extends in the radial direction towards the central axis $A_L$ of the pour spout 100 (see FIG. 2B) between the annular longitudinal skirt 320 and the bore seal 310 providing a leak tight closure device 1.

The lid portion 300 is re-sealably arranged on the pour spout 100. The internal threads 322 (see FIG. 1) of the lid portion 300 are configured to interact with the external threads 108 of the pour spout 100, allowing the lid portion 300 to be rotated/twisted about the central axis $A_L$ of the pour spout 100 and to be screwed off the pour spout 100 bringing the closure device 1 from a first/closed position to a second position which lid portion 300 non-sealingly covers the dispensing opening 118, and screwed on to the pour spout 100 bringing the closure device 1 from said second position to the first/closed position. In the second position the central axis Ac of the annular longitudinal skirt 320 of the lid portion 300 is different from the longitudinal centre axis $A_L$ of the pour spout 100.

When the closure device 1 is moved from the first/closed position to second position, the lid portion 300 is rotated until the internal threads 322 are released into a non-interacting position with the external threads 108 such that the lid portion 300 can be moved away from the pour spout 100 into the third position by flipping/pivoting the lid portion 300 around pivot axis $A_P$ of the hinge portion 500 (see FIG. 1) allowing content, e.g. a liquid, to be dispensed through the dispensing opening 118 of the pour spout 100.

The inner section 404 of the retainment portion extends upwardly from the lower end of the outer section 402 terminating at a free, upper end 406 displaying an annular, upwardly facing surface facing the blocking tongue 114, which annular surface is generally planar and perpendicular to the central axis $A_L$ of the pour spout. Consequently, the inner section 404 extends upwardly from the outer section 402 into the annular recess 126 (see FIG. 2B), and the upwardly facing surface of the free end 406 of the inner section 404 is configured to interact with the downwardly facing surface of the blocking tongue 114 of the pour spout 100 to prevent the retainment portion 400 from moving axially towards the dispensing opening 118 of the pour spout 100. The flange portion 110 of the pour spout prevents the retainment portion 400 from moving axially towards the bottom opening 116 of the pour spout 100 (see also FIG. 2A).

However, the inner section 404 is configured not to interact tightly with the inner side wall of the annular recess 126, thus allowing the retainment portion 400 to rotate about the centre axis $A_L$ of the pour spout 100. Consequently, the retainment portion 400 extends circumferentially around the pour spout 100 and the annular recess 126 defined by the blocking tongue 114 and the flange portion 110 forms retaining means preventing the retainment portion 400 from moving vis-à-vis the pour spout 100 in the axial direction z (see FIG. 2A) but allowing the retainment portion 400 to be rotated about the central axis $A_L$ of the pour spout 100. Hence, the retainment portion 400 is rotatably retained about the pour spout 100 when the lid portion 300 is twisted between the first and second position.

FIG. 8 shows a perspective view of a of a paperboard-based package 50 comprising the closure device 1 as discussed above wherein the lid portion 300 is in the third/open position.

The flange portion of the pour spout is not visible in FIG. 8 as it is fixed to an inside, annular wall section of the package 50 encircling a through-opening 52 in the package 50.

When the closure device is in the first, closed position, the external threads 108 of the neck portion 102 and the internal thread(s) of the skirt 320 interact to provide a tight seal between the second axial end 106 of the pour spout 100 and the lid portion 300, as is disclosed in FIG. 6A.

Opening the closure device, i.e. bring the closure device from the first, closed position to the third, open position, as is disclosed in FIG. 6A to C, generally involves the steps of:

- providing the closure device 1 in a closed assembled position,
- rotating/twisting the cap 200 about 20-35° in a first, anti-clockwise, rotational direction until the connecting bridges 606 of the separation line 600 are broken.
- continue rotating the lid portion 300 towards the second position until about 55°; i.e. bringing the cap 200 to rotate about the central axis $A_L$ in the first rotational direction until the internal threads 322 of the skirt 320 disengages from the external threads 108 of the neck portion 102, thus bringing the closure device to the second position, being the position where the lid portion 300 covers the dispensing opening 118 but does not provide a tight seal with the second axial end 106 of the pour spout 100; and
- bringing the lid portion 300 to pivot, or flip, in a second rotational direction about the pivot axis $A_P$ until the lid portion 300 is brought at least partly to a side of the dispensing opening 118.

During a first opening of the closure device, opening the closure device may also involve bringing the lid portion 300 to separate from the retainment portion 400 along the separation line 600. This may be effectuated during the said step of bringing the cap 200 to rotate in the first rotational direction by utilising reaction forces originating from the interaction between the internal and external threads to break the bridges 606 (see FIG. 3A).

Closing the closure device, i.e. bringing the closure devices from the third, open position to the first, closed position, generally involves the steps of:

- bringing the lid portion 300 to pivot, or flip, in a third rotational direction about the pivot axis $A_P$, which third rotational direction is opposite said second rotational direction, until the lid portion 300 is brought to cover the dispensing opening 118; and
- bringing the cap 200 to rotate about the central axis $A_L$ in a fourth rotational direction, which fourth rotational direction is opposite said first rotational direction, until the internal threads 322 of the skirt 320 engages the external threads 108 of the neck portion 102 to bring the lid portion 300 of the cap 200 into a tight seal with the second axial end 106 of the pour spout 100.

The pitch, number and circumferential extent of the internal and external threads may be configured to allow the closure device to be brought between the first and second position by means of a relatively limited rotational movement, e.g. by means of a rotational movement of no more than maximum 50°.

The invention claimed is:

1. A closure device for a paper or paperboard-based package, the closure device comprising a pour spout and a cap, the pour spout having a longitudinal center axis defining an axial direction, a circumferential direction and a radial direction of the pour spout, the pour spout comprising:

an annular longitudinal neck portion extending along the axial direction from a first axial end to a second axial end in a dispensing opening, the neck portion further comprising a plurality of external threads, occupying, in the axial direction a region located between a first plane and a second plane, wherein the second plane is arranged between the first plane and the second axial end, an annular flange portion for attaching the closure device to the package, the annular flange portion extending in the radial direction outwardly from the first axial end of the neck portion;

the cap comprising:

a lid portion comprising an annular longitudinal skirt having at least one internal thread configured to releasably interact with said external threads;

a retainment portion being rotatably retained around said neck portion; and a hinge portion permanently connecting the lid portion to the retainment portion, the hinge portion having a pivot axis about which the lid portion is pivotally movable, the lid portion being operable between a first position in which the lid portion sealingly covers said opening of the pour spout, a second position in which the lid portion non-sealingly covers the opening, and a third position in which the lid portion is located at least partly at a side of the opening, wherein the pivot axis is located between the first plane and the second axial end of the neck portion in the first position, in the second position and in the third position.

2. The closure device according to claim 1, wherein the pivot axis is located level with the second plane or between the first and second planes.

3. The closure device according to claim 1, wherein the pour spout comprises 4 to 10 evenly distributed circumferentially extending external threads.

4. The closure device according to claim 1, wherein each external thread comprises a circumferential extent of 50° to 140°.

5. The closure device according to claim 1, wherein each external and internal thread has a helix angle comprising 5.0° to 10.0°.

6. The closure device according to claim 1, wherein each internal thread comprises a circumferential extent of 20° to 100°.

7. The closure device according to claim 1, wherein the annular skirt comprises a first internal thread and a second internal thread, wherein the first internal thread has a tangential center point located at a circumferential distance of 150° to 185° from a tangential center point of the second internal thread.

8. The closure device according to claim 7, wherein the hinge portion is arranged at the periphery of the annular skirt and the hinge portion comprises a tangential center point, and wherein the first internal thread comprises a tangential center point arranged at a circumferential distance from 60° to 85° from the tangential centre center point of the hinge portion.

9. The closure device according to claim 1, wherein the second axial end of the pour spout comprises a sealing tongue extending towards the center axis of pour spout.

10. The closure device according to claim 9, wherein the sealing tongue is oblique in the direction towards the first axial end of the pour spout.

11. The closure device according to claim 1, wherein the lid portion comprises an annular longitudinal bore seal having a common center axis with the annular longitudinal skirt both extending in a same longitudinal direction and arranged such that the second axial end of the pour spout is arranged between the skirt and the bore seal when the lid portion is in the first position.

12. The closure device according to claim 11, wherein the bore seal has a gradually increasing longitudinal extent from a first position of the bore seal being proximate the hinge portion towards a second position of the bore seal being distal the hinge portion.

13. The closure device according to claim 12, wherein the first position of the bore seal being proximate the hinge portion has a longitudinal extent when the lid portion is in the first position extending between the second axial end of the pour spout and a plane in which the pivot axis is arranged.

14. The closure device according to claim 1, further comprises a separation line extending circumferentially around the cap between a first endpoint and a second endpoint, the first and second endpoints defining between them the hinge potion, wherein the separation line is configured to separate the lid portion from the retainment portion when the lid portion is brought from the first position to the second position during a first opening of the closure device.

15. An assembly comprising a paper or paperboard-based package and a closure device according to any one of the preceding claims.

* * * * *